US006908260B2

(12) United States Patent
Beard et al.

(10) Patent No.: US 6,908,260 B2
(45) Date of Patent: Jun. 21, 2005

(54) RECEPTABLE ASSEMBLY AND METHOD FOR USE ON AN OFFSHORE STRUCTURE

(75) Inventors: Michael E. Beard, Spring, TX (US); Carl F. G. Baxter, Virum (DK); Nicholas Cunliffe, Lanes (GB); Patrick L. Boster, The Woodlands, TX (US)

(73) Assignee: RTI Energy Systems, Inc., Niles, OH (US)

( * ) Notice: Subject to any disclaimer, the term of this patent is extended or adjusted under 35 U.S.C. 154(b) by 0 days.

(21) Appl. No.: 10/821,744

(22) Filed: Apr. 9, 2004

(65) Prior Publication Data

US 2004/0197152 A1 Oct. 7, 2004

Related U.S. Application Data

(62) Division of application No. 09/960,083, filed on Sep. 21, 2001.

(51) Int. Cl.[7] ..... F16L 3/00
(52) U.S. Cl. ..... 405/154.1; 405/224
(58) Field of Search ..... 403/365, 367, 403/52, 53, 83, 84, 91; 405/154.1, 184.4, 195.1, 224, 224.2, 224.3, 224.4, 166; 166/351, 352, 359, 367

(56) References Cited

U.S. PATENT DOCUMENTS 3,922,870 A * 12/1975 Recalde ..... 405/166
5,447,392 A * 9/1995 Marshall ..... 405/224.4
5,905,212 A * 5/1999 Moses et al. ..... 73/862.451

* cited by examiner

*Primary Examiner*—John Kreck
(74) *Attorney, Agent, or Firm*—Browning Bushman P.C.

(57) ABSTRACT

A receptacle 20 is removably secured to hull 12 of an offshore structure 10, and supports an elongate member 14, which may be a riser string, extending downward to the sea bed or to another structure. The elongate member 14 includes a tapered supporting surface 18, which may be provided on a tapered stress joint or flex joint 16. The receptacle 20 includes a mounting bracket 22 secured to the structure 10, and a basket housing 30 which has a tapered interior surface 34 for mating engagement with the exterior surface 18. According to the method, the mounting bracket is fixed to the structure, and the receptacle basket positioned about the elongate member and the assembly then positioned for being supported on the bracket. The supporting surface on the basket may be arranged for positioning the elongate member at a selected azimuth and declination relative to the offshore structure.

18 Claims, 6 Drawing Sheets

FIG. 1
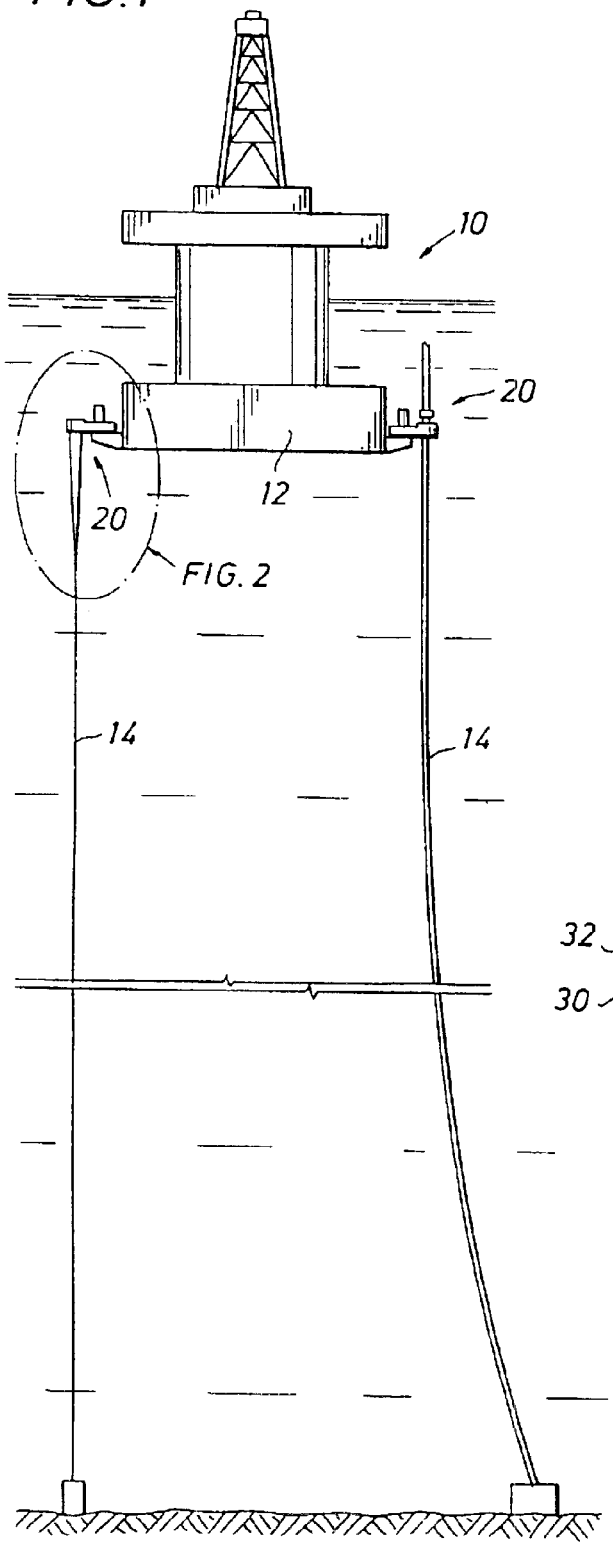
FIG. 3
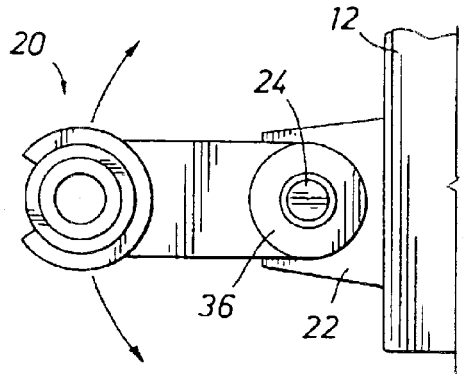
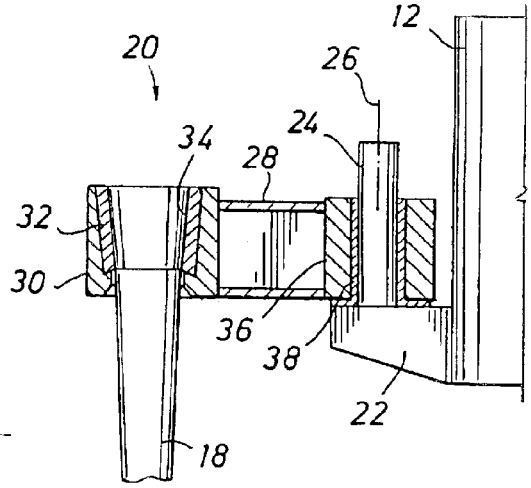
FIG. 2

FIG. 4
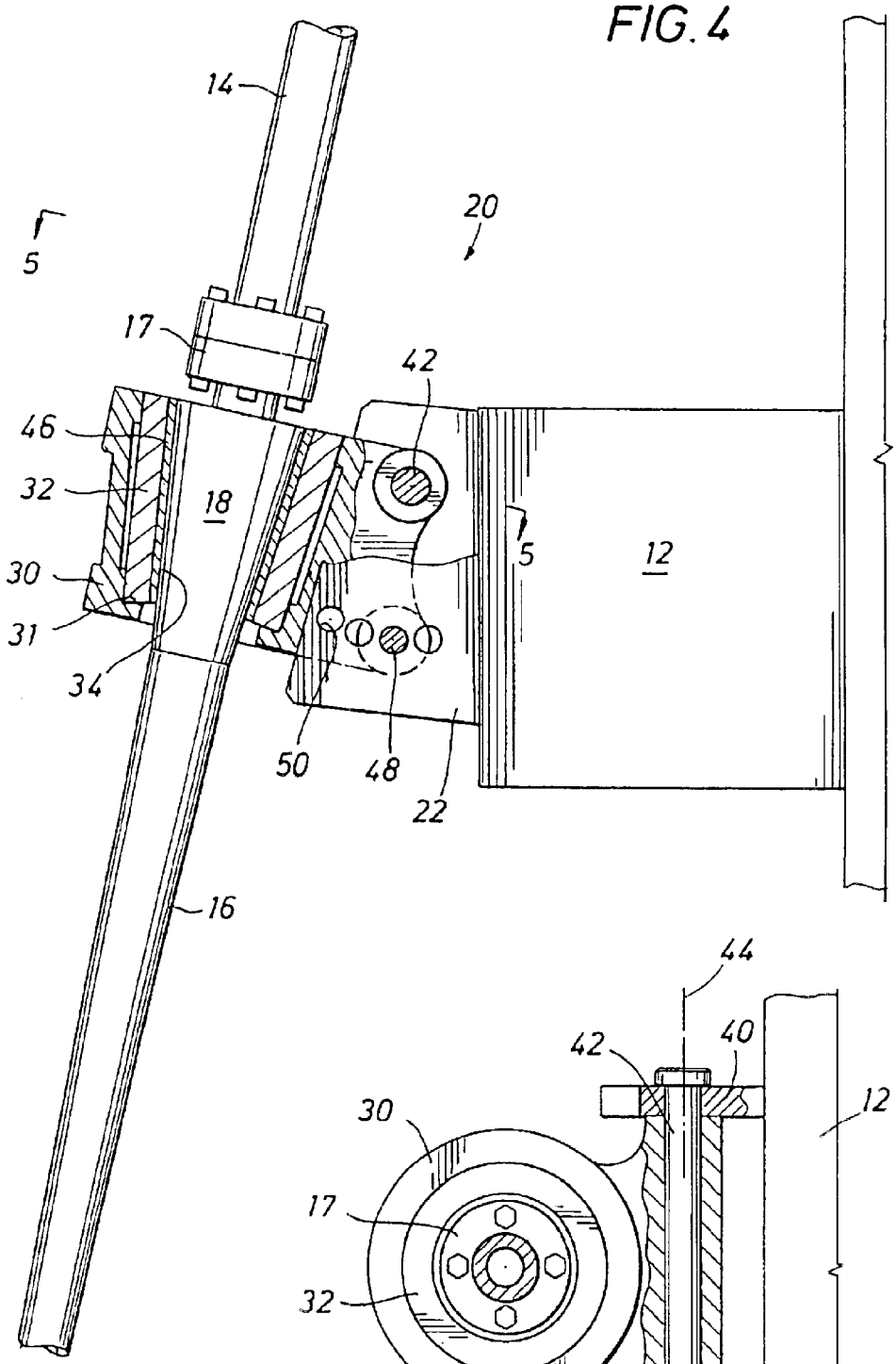
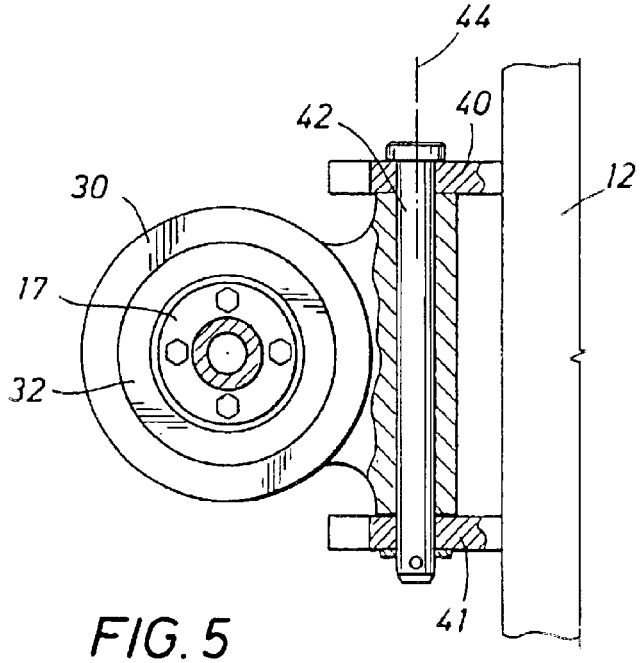
FIG. 5

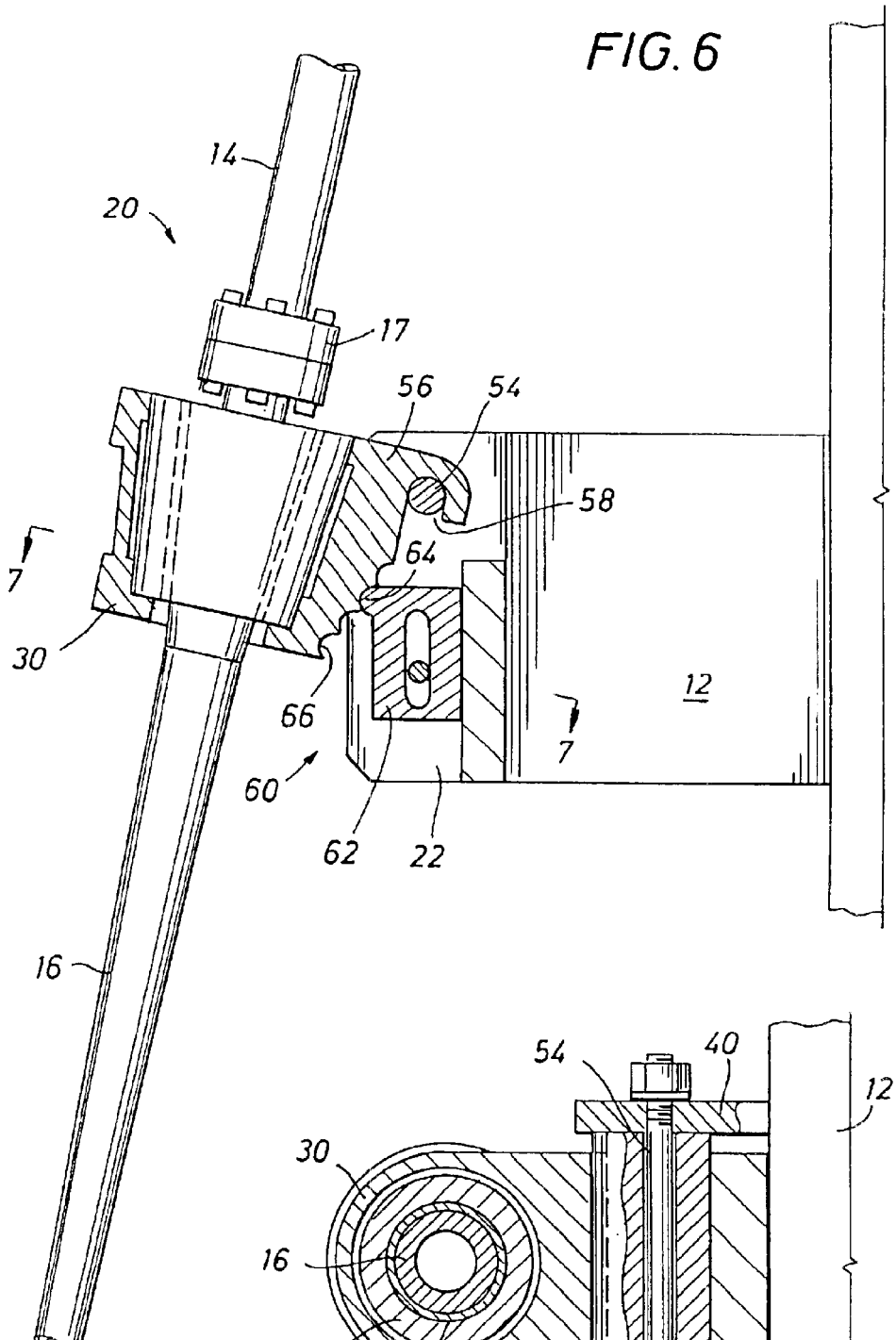
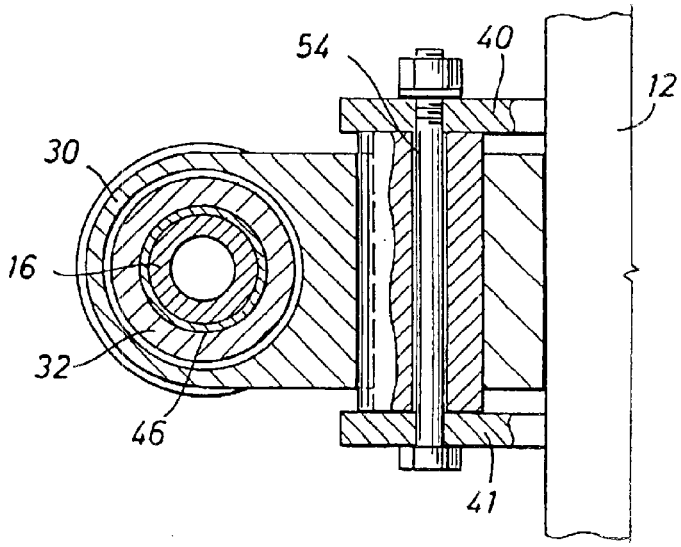
FIG. 7

FIG. 8
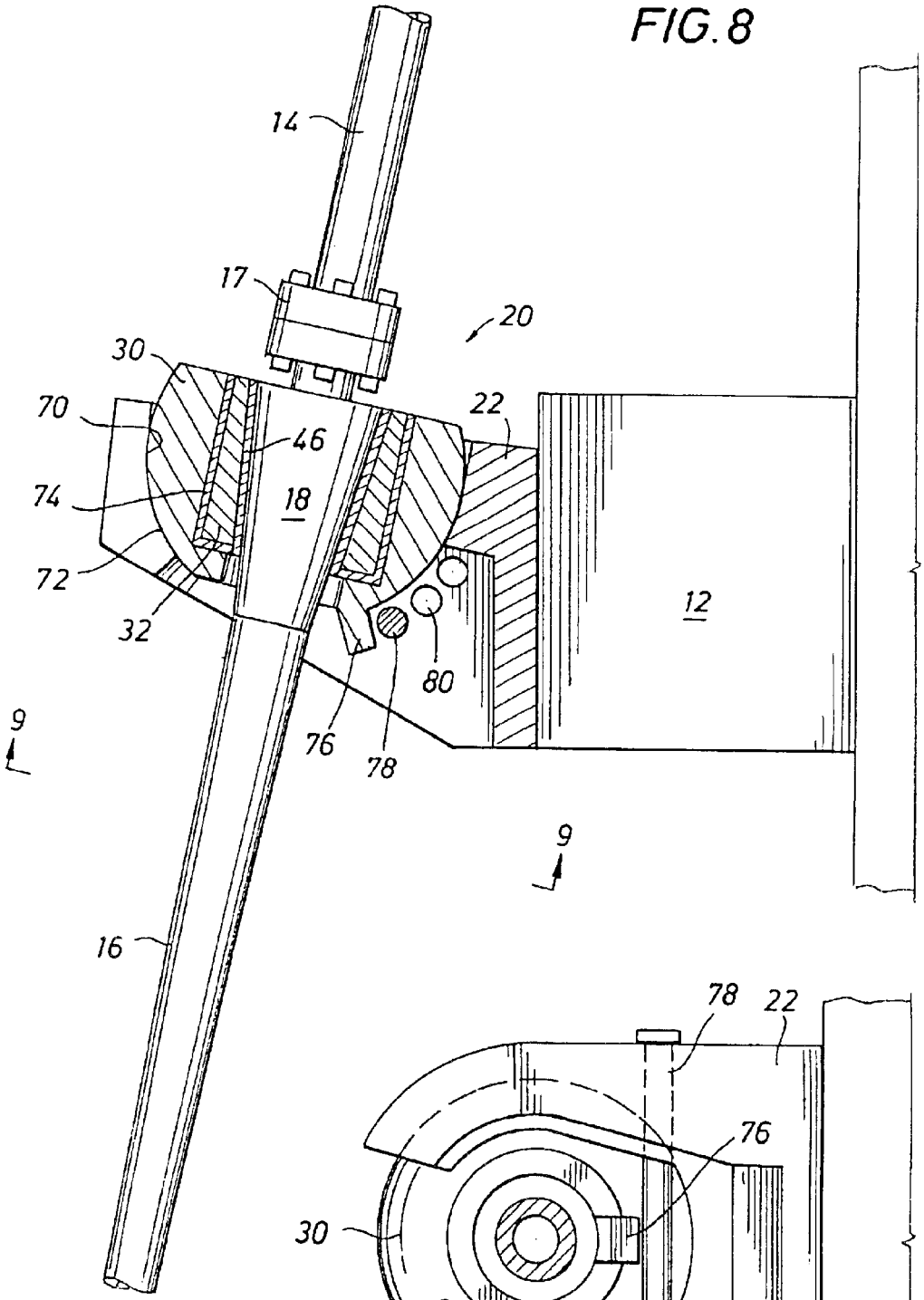
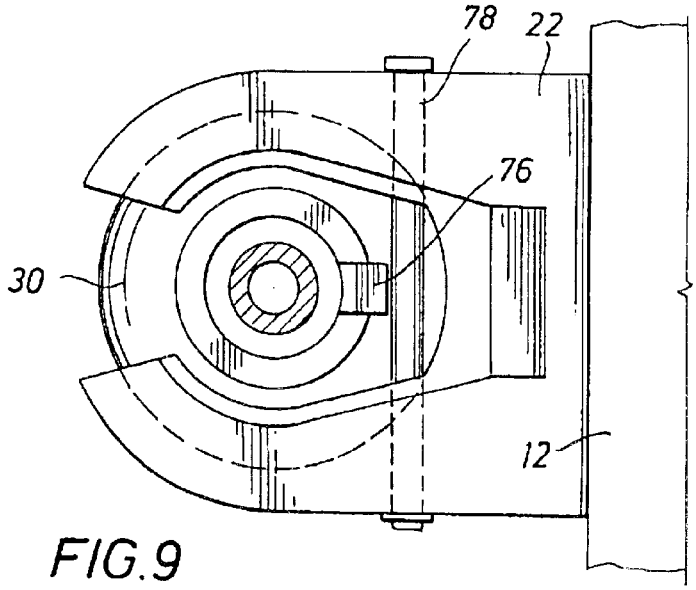
FIG. 9

FIG. 10
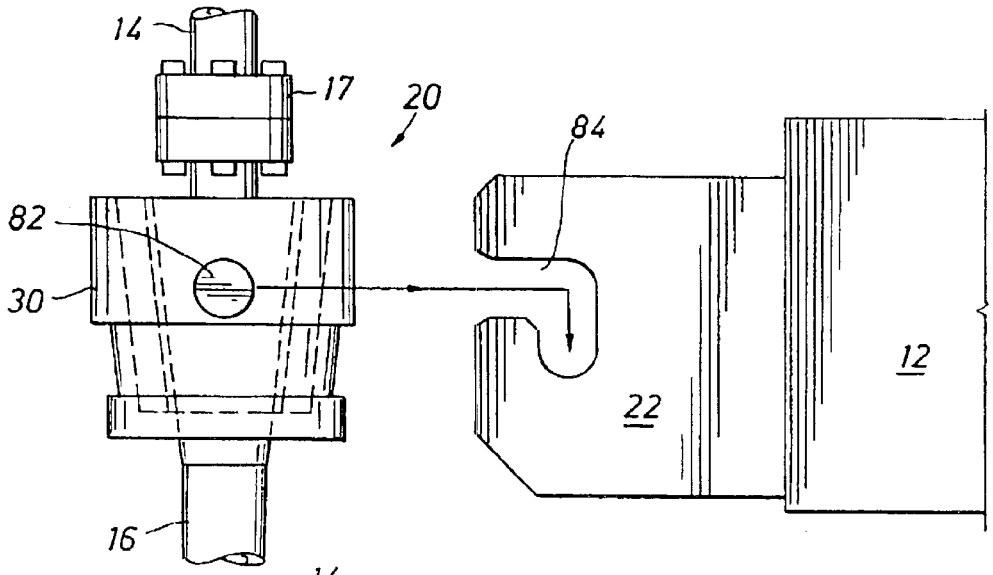
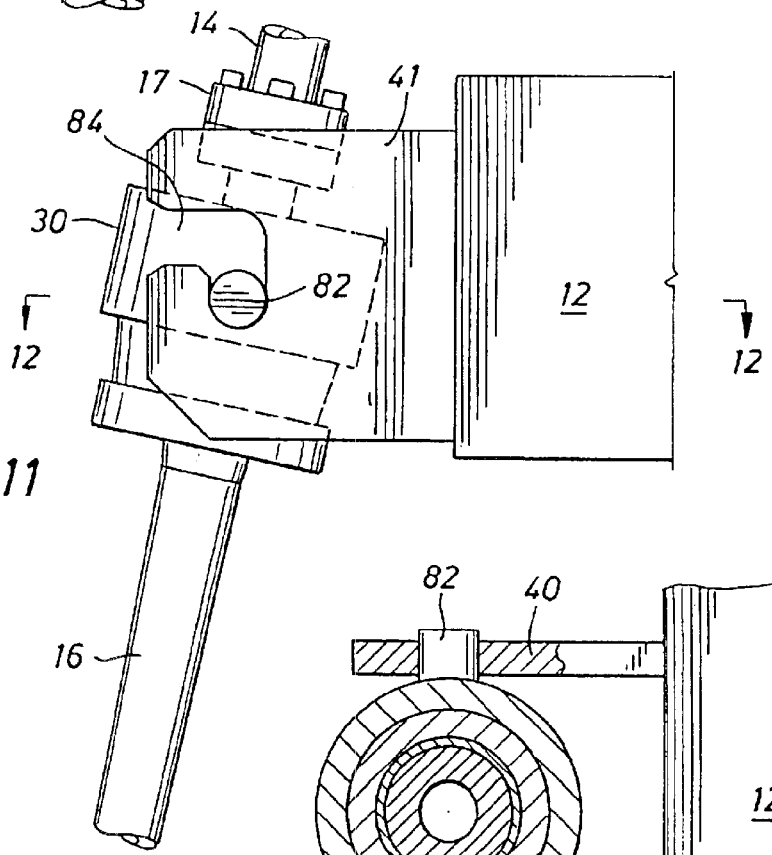
FIG. 11
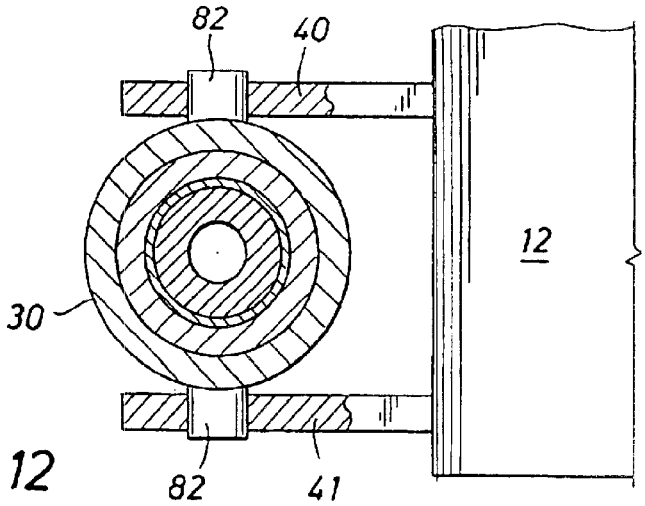
FIG. 12

FIG. 13
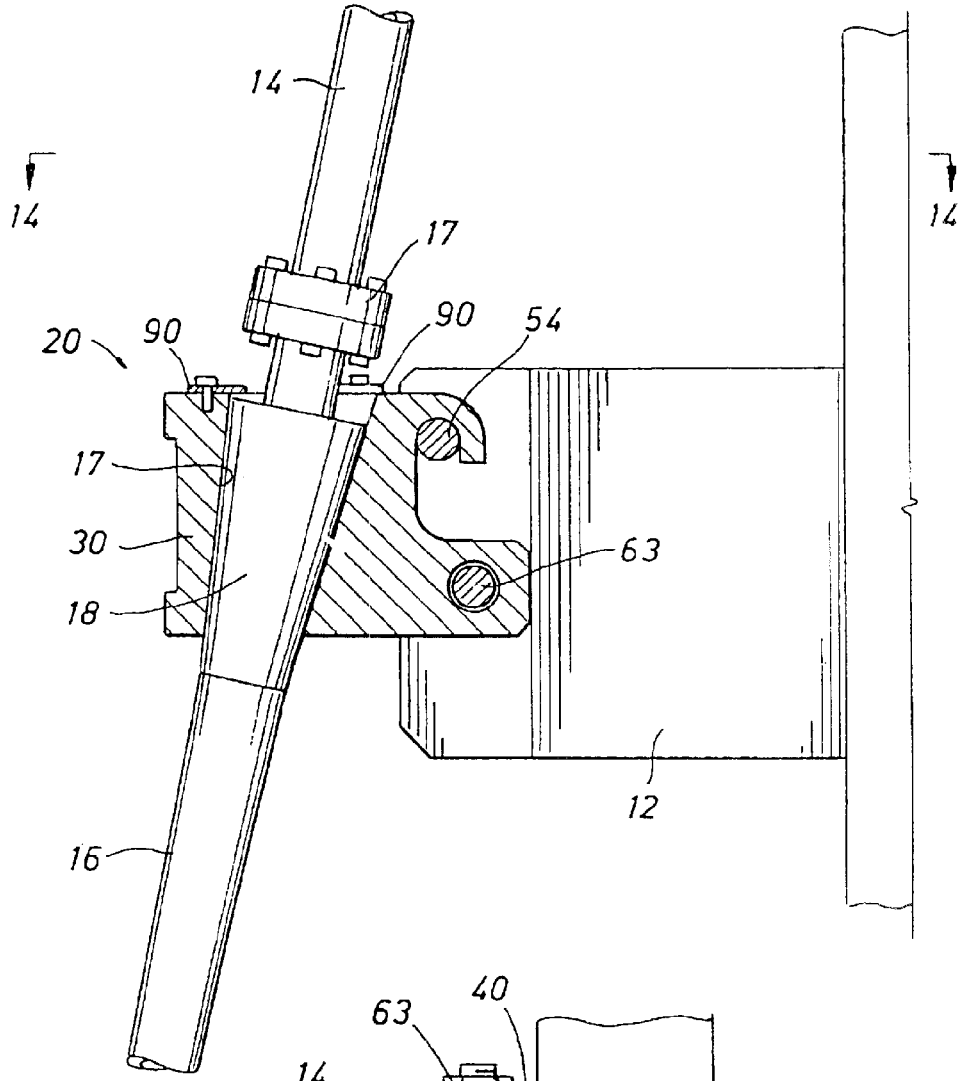
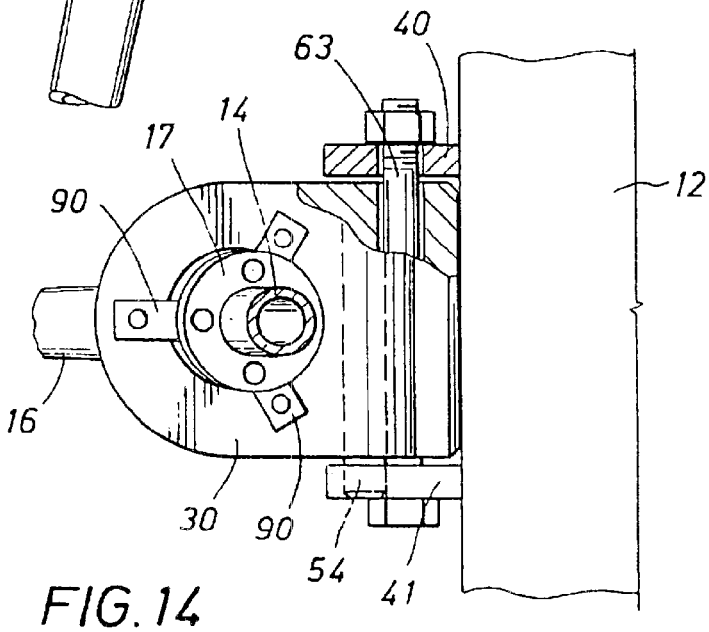
FIG. 14

RECEPTABLE ASSEMBLY AND METHOD FOR USE ON AN OFFSHORE STRUCTURE

This application is a divisional of copending U.S. patent application Ser. No. 09/960,083, filed 21 Sep. 2001, titled "RECEPTACLE ASSEMBLY AND METHOD FOR USE ON AN OFFSHORE STRUCTURE".

FIELD OF THE INVENTION

The present invention relates to receptacles of the type conventionally supported on an offshore oilfield structure, such as an oilfield production vessel, which are adapted for receiving in a central throughbore thereof various types of elongate members which permanantly extend from substantially the surface to the seabed or to another offshore structure. More particularly, this invention relates to an improved receptacle which may be removably supported on the offshore structure, and may be moved with a stressjoint or a flex joint of an elongate member to be supported on a mounting bracket fixed to the offshore structure. The invention also includes a method which allows the receptacle basket with a selected azimuth and declination to be inserted about the elongate member, then the assembly positioned for supporting the basket and suspended elongate member from a bracket attached to the offshore structure.

BACKGROUND OF THE INVENTION

Various types of elongate members extend from a petroleum offshore structure to the seabed or to another structure. Typical elongate members include export risers, import risers, catenary risers, tension legs, transport lines, various umbilical tubes comprising an umbilical system, and bundles of cables and tethers. The elongate tubular conventionally is a metal material, although the elongate member may be fabricated from a non-metallic or composite material. In many applications, the elongate member includes a flow path for fluid, whether gas, liquid or a mixture thereof. A bundle of umbilical tubes or cables supported from a single receptacle may be considered one elongate member. Those skilled in the art will appreciate the substantial weight of these elongate members, and recognize that these members are conventionally "hung off" from the side of an offshore structure by a receptacle fixed to the structure and typically having an open throat therein for laterally receiving the elongate member. The array of elongate members may thus be organized as each member is hung off the side of the offshore structure. The term "offshore structure" as used herein is intended in its broadest sense to encompass various types of offshore oilfield production structures, including tension leg platforms, deep-draft casson systems, spars, semi-submersible vessels, and fixed or floating exploration and/or production vessels. In each case, it is conventional to attach a plurality of open throat receptacles to the hull of the structure, so that subsequently an elongate member may be laterally positioned within each receptacle and thereby be supported from the structure.

As indicated above, the elongate member imparts substantial forces to the offshore structure, and accordingly the receptacle basket itself which is fixed to the structure must be large and rugged. A surface on the interior of the basket has a receiving throat adapted for mating engagement with a similar exterior surface affixed to the elongate member. The open throat basket is generally considered essential to provide the desired flexibility so that the elongate member may be laterally positioned within the basket while it is fixed to the structure.

In addition to the size and weight of conventional baskets fixed to offshore structures, prior art baskets have other significant drawbacks. The basket is conventionally fixed to the structure with the bore in the basket at a selected azimuth and declination intended for receiving an elongate member with a planned layout. Months later, when the elongate member which is to be received within that basket has a different azimuth and declination, costly modifications to the basket are frequently required. In some cases, adapter bushings have been used to fit between an existing basket and the elongate member to achieve the desired azimuth and declination for the elongate member. Modifications to baskets already fixed to the offshore structure, including modifications accomplished with adapter bushings, may be very expensive and time consuming, and may delay the start up of the recovery operation.

The disadvantages of the prior art are overcome by the present invention, and an improved receptacle assembly for use on an offshore oilfield production structure is hereinafter disclosed. The receptacle assembly of the present invention is relatively simple, has a high reliability, and has increased flexibility compared to prior art receptacle assemblies. A new method of hanging an elongate member from an offshore oilfield production structure is also disclosed.

SUMMARY OF THE INVENTION

A receptacle assembly is provided for permanently supporting one or more elongate members on a surface or near surface offshore oilfield production structure, such as a vessel or platform. The receptacle assembly includes a mounting bracket fixed or otherwise attached to the structure, preferably by welding, but also by other mechanical attachment, and a receptacle basket supported on the mounting bracket. An elongate member, such as a riser, may extend downward from the structure to the seabed or to another structure, such as another vessel or another platform. The riser may include a tapered supported surface, such as conventionally provided on a tapered stress joint or flex joint, which surrounds the riser. The basket has a central throughbore therein for receiving the flex joint, stress joint, or other member supporting the elongate member from the basket, and includes a basket supporting surface spaced circumferentially about the throughbore for planar engagement with the supported surface on the stress joint.

The receptacle basket may be movably mounted on the bracket for reducing stresses transmitted by the elongate members to the structure. In one embodiment, a projecting member may be provided on the basket and the receiving member provided within the mounting bracket. The receptacle basket may be pivotally supported on the bracket and movable about a horizontal pivot axis. In other embodiments, the basket may be movable about a vertical axis or may pivot as a gimbal joint relative to the supporting structure.

According to a method of the invention, the mounting bracket is fixed to the structure. The receptacle basket is positioned about the supported surface on the elongate member, so that the basket supporting surface is positioned for subsequent engagement with the supported surface on the elongate member. The bore in the basket may be machined to form a selected azimuth and declination angle, so that the supported elongate member reduces stresses transmitted to the hull. Conveniently, this selection of the bore angle within the basket may be made just prior to hanging the elongate member, although the mounting bracket may have been fixed to the hull months prior. The basket and elongate member assembly may thereafter be suspended from the mounting bracket, thereby supporting the elongate member from the structure.

The present invention significantly increases the flexibility of mounting various elongate members from an offshore structure. Since the receptacle basket is provided with the elongate member, the basket structure may be changed without changes to the components fixed to the offshore structure. An adjustment member may be provided for adjusting the position of the receptacle basket relative to the mounting bracket, and the position of the basket relative to the mounting bracket may be fixed by a locking member.

It is an object of the present invention to provide an improved receptacle for supporting an elongate member from an offshore structure, including a mounting bracket secured to the structure and a receptacle basket thereafter supported on the mounting bracket and having a basket supporting surface for planar engagement with the supported surface on the elongate member. It is a related object of the invention to fix the mounting bracket to the offshore structure, position the receptacle basket about the supported surface on the elongate member, then suspend the assembly including the receptacle basket and the elongate member from the mounting bracket, thereby supporting the elongate member from the structure. This method allows for a change in size of the bore in the basket, as well as the declination and azimuth of the supporting surface on the basket, shortly before installation of the basket on the mounting bracket. Also, the configuration of the basket may be changed to receive a particular flex joint, a particular stress joint, or other member used to support the elongate tubular on the basket.

These and further objects, features, and advantages of the present invention will become apparent from the following detailed description, wherein reference is made to the figures in the accompanying drawings.

BRIEF DESCRIPTION OF THE DRAWINGS

FIG. 1 is a simplified pictorial view of an offshore oilfield production structure with elongate members extending therefrom to the sea floor.

FIG. 2 is a side view of a receptacle basket generally shown in FIG. 1 mounted about a substantially vertical axis.

FIG. 3 is a top view of the receptacle basket shown in FIG. 2.

FIG. 4 is a side view of an alternate embodiment of a receptacle basket mounted for pivotal movement about a substantially horizontal axis relative to the supporting structure.

FIG. 5 is a cross-sectional view taken along lines 5—5 in FIG. 4.

FIG. 6 is a side view of another embodiment of a receptacle basket mounted for pivotal movement relative to the supporting structure.

FIG. 7 is a cross sectional view taken along lines 7—7 in FIG. 6.

FIG. 8 is a side view of a receptacle basket mounted for gimbal movement of the receptacle basket relative to the supporting structure.

FIG. 9 is a cross-sectional view taken through lines 9—9 in FIG. 8.

FIG. 10 is a side view of another embodiment of a receptacle basket prior to positioning the receptacle basket on the mounting bracket.

FIG. 11 is a side view of the receptacle basket shown in FIG. 9 supported on the mounting bracket.

FIG. 12 is a cross-sectional view taken along lines 12—12 in FIG. 11.

FIG. 13 is a side view of another embodiment of a receptacle basket supported on a mounting bracket.

FIG. 14 is a partial cross-sectional view taken along lines 14–14 in FIG. 13.

DETAILED DESCRIPTION OF PREFERRED EMBODIMENTS

FIG. 1 simplistically depicts an offshore oilfield production structure 10 which is provided at or near the surface of the water. The offshore structure 10 may be a tension leg platform, a deep draft system, a spar, a semi-submersible vessel, a fixed or floating production vessel, or other such supporting structure. The structure 10 is a surface or next surface structure which, if not anchored to the seabed, includes flotation equipment to maintain at least a portion of the structure above the water level. The connection of the elongate member to the hull or other component of the offshore structure may be positioned above, below, or substantially at the water level. As shown in FIG. 1, the structure includes a hull 12, and a plurality of elongate members 14 extend downward from the structure 10 to a seabed. Although only two elongate members are shown in FIG. 1, normally "rows" of selected elongate members are permanently hung off the offshore structure, as discussed below. The receptacle assembly of the present invention is thus used for supporting or "hanging off" various elongate members which are then supported by the offshore structure in a permanent installation. The "permanent" support of elongate members from the offshore structure, as that term is used herein, means that the elongate members are intended for being supported a year or more from the offshore structure. In many cases, the elongate members will be supported in the offshore structure for five years or more, and typically the receptacle assembly of the present invention is intended for supporting structures during a life of about twenty years. Also, each of the elongate members may be hung off a side of the offshore structure. In other applications, the elongate members may be hung off beneath the platform surface of the offshore structure, or may be positioned within the interior of the outer framework of the structure. In other embodiments, those skilled in the art will appreciate that the elongate members 14 may extend downward from the hull 12 and then are passed over to another offshore structure.

Typical elongate members which are hung from a hull 12 include various types of risers, umbilical tube bundles, or cables. On the left side of the structure 10 shown in FIG. 1, receptacle 20 supports elongate member 15, which as depicted simplistically represents a tubular conduit, riser or other flowline, and which typically extends upward from the hull 12 to the production platform above the surface of the water, and extends downward from the hull to the sea floor. On the left side of FIG. 1, receptacle 20 supports a tension leg cable 13 which extends to the sea floor. In many instances, the elongate member will be a single member, such as a riser, other tubular, or cable. In the application of choke and kill lines, a bundle of tubes may form the elongate member. The receptacle basket as disclosed herein is particularly well suited for supporting a riser string from the structure 10. FIG. 1 also generally depicts two receptacles 20 according the present invention each for supporting one or more elongate members from the vessel. Those skilled in the art appreciate that from 6 to 18 receptacles are typically fixed to the hull or other supporting member of the structure 10.

As shown in FIGS. 2 and 3, the elongate member 14 may include a tapered stress joint 16 having a tapered supported surface 18, which preferably is a frustoconical surface, for planar engagement with a mating surface in a receptacle basket. Alternatively, the elongate member may include any type of supported surface for planar engagement with a supporting surface on the receptacle basket. The tapered flex joint 16 may include a flange-type coupling 17 at each end thereof.

FIGS. 2 and 3 depict a receptacle assembly 20 including a mounting bracket 22 fixedly secured to the structure, typically by welding, and a pin 24 having a substantially vertical axis 26 fixed to the bracket 22. The bracket 22 alternatively could be attached by other mechanical connectors to the structure. The receptacle basket includes an outer housing or body 30 having a liner 32 therein, with the liner 32 forming the tapered interior surface 34 for mating engagement with the exterior tapered surface 18 of the tapered stress joint 16. The elongate member 14 may thus be a riser string, with the risers sections connected by threads or other mechanical connectors, such as flanges 17. The tapered stress joint 16 supports the weight of the hung off riser string. In other embodiments, the liner may be eliminated and the annular body 30 may form the tapered supporting surface, as disclosed subsequently. Connecting member 28 may be used to interconnect the body 30 with bushing member 36. A low friction sleeve and supporting flange 38 formed from a high strength plastic or other non-metallic material, including a composite material, may be used to reduce friction between the bushing member 36 and the pin 24, thereby facilitating movement of the body 30 and the elongate member about the axis 26.

FIG. 4 depicts an alternate embodiment wherein the receptacle basket 20 is supported on a mounting bracket 22, which as shown in FIG. 5 may include substantially vertical supporting plates 40 and 41. The receptacle basket body 30 and the internal sleeve 32 are mounted on the plates 40 and 41 by a pin 42, which allows rotation of the receptacle basket about a substantially horizontal axis 44. As shown in FIG. 4, the metal liner 32 may optionally include another liner 46 formed from a selected plastic or other non-metallic material, including a composite material. Most importantly, the receptacle basket provides the basket supporting surface 34 within a central throughbore of the receptacle basket body 30 for planar engagement with the supporting surface 18 of the tapered stress joint or flex joint 16.

FIG. 4 also depicts a pin or screw 48 which is mounted to the body 30. The pin 48 may be threaded or unthreaded, and is passed through one of the respective ports 50 provided in the body 30. The selection of the spaced apart port 50 for receiving the pin 48 provides a mechanism for effectively selecting the angular position of the receptacle basket relative to the support structure 22, and thereby the angle of the elongate member 14 relative to the structure 22. Those skilled in the art will appreciate that the angular positioning of the elongate member with respect to the supporting structure is typically not as large as shown in the figures, and is exaggerated for clarity.

FIG. 4 also depicts that the liner 32 may include a tapered interior non-metallic liner 46 having a tapered surface 34 for engagement with the tapered surface 18 of the tapered stressjoint 16. A plastic liner which contacts the tapered stress joint or flexjoint is disclosed in U.S. application Ser. No. 09/733,438, filed Dec. 8, 2000, and entitled "Mounting System for Offshore Structural Members Subjected to Dynamic Loadings," hereby incorporated by reference. The liner 32 is also supported on a tapered lower surface 31 of the body 30, and assists in centering the liner 32 with respect to the body 30.

For the embodiments shown in FIGS. 6 and 7, a large rod, such as bolt 54, may extend between the vertical supporting plates 40 and 41. In this case, the receptacle basket body 30 includes a hook flange 56 forming a slot 58 sized to receive the bolt 54. A pin such as pin 48 described above may be used instead of bolt 54. For this embodiment, the liner has been eliminated, and the inner surface 17 of the body 30 engages the tapered surface 18 of the joint 16. The weight of the elongate member is thus transmitted from the body 30 to the bolt 54, and then from the plates 40 and 41 to the offshore structure. FIGS. 6 and 7 also depict an adjustment mechanism 60 for adjusting the angular position of the bore in the basket and thus the angular position of the elongate member received in that bore relative to the supporting structure. Stop piece 62 may be movable relative to the supporting structure, may be locked in a selected vertical position in a conventional manner. Pin 63 is thus positioned within a selected throughbore 65 in stop piece 62. Protrusion 64 on the stop 62 is designed for mating with a selected one of the cut outs 66 in the body 30. Accordingly, the angular position of the elongate member received within the body 30 may be adjusted by raising or lowering the stop member 62 for engagement with a selected cut out in the body 30.

FIGS. 8 and 9 depict yet another embodiment wherein the mounting bracket 22 includes a portion of a spherical surface 70. Receptacle body 30 has spherical exterior surface 72 for planar engagement with the mating surface of the mounting bracket. In the FIG. 8 embodiment, a non-metallic material liner 46 forms the tapered surface for engagement with the conical surface of a flex joint 18, stress joint, or other supporting structure, and optionally another non-metallic layer 74 may be provided between the body 30 and the insert 32.

FIGS. 8 and 9 depict a stop 76 fixed to the body 30. Pin 78 may be positioned within a selected one of the receiving holes 80 provided in the mounting bracket 22. By positioning the pin 78 in a selected receiving hole, the angular position of the elongate member relative to the structure may be easily adjusted, and may also be fixed in position. Although not shown, it should be understood that a similar pin may be provided on an opposed side of the stop 76, so that pins may be used to lock in the angle of the elongate member in a direction of the plane shown in FIG. 8. A similar stop and pin mechanism, not shown, may be provided for adjusting the angular position of the flexjoint in a transverse direction. The embodiment as shown in FIGS. 8 and 9 thus provides a gimbal joint between the supporting structure and the elongate member, arid allows the lower end of the flexjoint or stress joint to be moved closer or further away from the supporting structure (to the left and to the right as shown in FIG. 9) and also to be moved laterally relative to the structure (perpendicular to the plane as shown in FIG. 9).

As shown in FIGS. 10–12, the receptacle basket 30 may include a short stud or ear 82 projecting outward from each side of the body 30. The mounting bracket 22 as shown in FIG. 10 may include a pair of plates 40 and 41 as shown in FIG. 12, and each plate may be provided with a J-shaped slot 84 sized for receiving one of the ears 82. FIG. 11 depicts the ear 82 positioned within the lowermost portion of the slot 84.

A feature of the present invention is that the receptacle basket may be positioned about the elongate member with a basket supporting surface positioned for planar engagement with the supported surface on the elongate member. This assembly, including the flex joint, stress joint 16, or other supported surface of the elongate member, and the body 30 as shown in FIG. 6, may then simply be lowered in place about the pin 54. For the embodiment as shown in FIGS. 2 and 3, the flex joint or stress joint and receptacle basket may be positioned over the pin 24, and the bushing 36 lowered into position over the pin 24. Similarly, the basket and flex joint or stress joint assembly may be positioned relative to the mounting bracket 22 so that the pin 42 as shown in FIG. 4 may be passed through the mounting bracket supporting plates and the body 30 to support the receptacle basket from the mounting bracket. The FIG. 6 embodiment and the FIG. 10 embodiment benefit from ease of hanging off the elongate member, which is significant in many oilfield operations. In the FIGS. 8 and 9 embodiment, the body of the receptacle basket may be lowered in place with respect to the mounting bracket. In the FIGS. 10–12 embodiment, the receptacle basket with the tapered flexjoint therein may be moved laterally into the J-slot 84, then lowered so that the ears 82 rest within the lowermost portion of the J-slot, and the basket and flex joint assembly then supported on the mounting bracket. In each case, the joint of the elongate member and receptacle basket assembly may be easily removed from the mounting bracket by reversing the procedure discussed above. A clevis arrangement may be used instead of the J-slot.

The receptacle basket as disclosed herein need not include an open throat. By providing an annular basket body which fully encircles the elongate member, the size and weight of the basket may be reduced. This advantage alone is significant compared to prior art open throat baskets. In some cases, it may be desirable to provide a receptacle basket that has an open throat so that the elongate member can be laterally moved on or off the basket. For the embodiment shown in FIGS. 8 and 9, a throat has been provided in the mounting bracket so that the receptacle basket and elongate member may be laterally moved into position over the mounting bracket then lowered in place to be supported from the mounting bracket.

The supported surface on the elongate member as shown on the drawings is a tapered supported surface. Conventional elongate members include such tapered supporting surfaces on both flex joints and tapered stress joints, in part because the engaging tapered surfaces allow relatively high loads to be safely transmitted between the elongate member and the hull. The engaging surfaces on the elongate member and the receptacle basket need not be tapered surfaces as shown to provide the desired load transmitting function. In one embodiment, for example, a generally horizontal annular planar supported surface on the elongate member may engage the supporting generally horizontal planar surface on the receptacle basket.

For each of the embodiments disclosed herein, one of the mounting bracket and the receptacle basket includes a projecting formation and the other of the bracket and receptacle basket include a receiving formation. In the FIG. 2 embodiment, the projecting member or projecting formation is the pin 24 provided on the bracket, while the receiving member or receiving formation is the bushing 36. In the FIG. 4 embodiment, the projecting formation is the pin 42 which structurally may be considered part of the mounting bracket, while the receiving formation is the throughbore in the body 30 for receiving the pin 42. In the FIG. 6 and FIG. 13 embodiments, the projecting formation is the bolt 54 which is part of the mounting bracket 22, while the receiving formation is the portion 56 of the body 30 forming the slot 58. In the FIG. 8 embodiment, the receiving formation is the central bore in the bracket 22 forming the spherical surface 70, while the projecting formation is the body 30 having a mating surface 72. Finally, in the FIG. 10 embodiment, the projecting member or formation are the ears or devises 82 on the body 30, while the receiving formation are the plates 40 and 41 which form the slots 84 for receiving the ears.

FIGS. 13 and 14 depict a significant feature of the present invention. A receptacle basket 30 is shown with a bore at a selected angle, i.e. a selected azimuth and declination, relative to the body 30 and thus relative to the hull 12. The tapered supporting surface 17 which defines the bore in the basket 30 is thus machined at the desired angle and declination, e.g., 8° off vertical and 45° south and away from the structure 12 as shown in FIG. 14. In most applications, the mounting bracket will be fixed to hull months prior to the time when the elongate member is hung from the hull. Layout arrangements frequently change, so that the selected azimuth and declination of the elongate member, and thus the selected angle of the bore in the basket, changes in the months between fabrication of the hull with the supporting bracket and the operation of hanging the elongate member. Also, the diameter of the elongate member, and thus the diameter of the supporting surface of the basket, may change subsequent to fabrication of the hull and supporting brackets. The configuration of the basket may be changed from that originally intended to receive a flex joint to one for receiving a tapered stress joint. A standard basket may thus have its bore machined at a selected angle to match the azimuth and declination desired for the elongate member, and this machining may occur months after the bracket is secured to the hull. The basket 30 with the selected bore angle as shown in FIG. 13 may then be slipped over the flanged end of the elongate member, and the elongate member and basket as an assembly then easily supported from the bracket and thus properly positioned with respect to the hull at the desired azimuth and declination. The position of the basket 30 relative to the mounting bracket and the hull may thus be fixed and locked into place. FIG. 14 shows bolt 63 extending between plates 40 and 41 and received within a throughbore in the body 30 to lock in the position of the body. Also, the use of adjustment members as discussed above to alter the angular position of the body 30 may reduce or modify the angle of the bore in the body 30. In many applications, the use of a basket 30 with a basket supporting surface at a selected angle and declination may obviate the need for the basket to be movable relative to the mounting bracket once the basket and elongate member are hung off the bracket.

FIG. 13 also shows a convenient stop 90 positioned at the upper end of the basket 30 for engagement with the lower surface of the flange 17. The assembly, including the joint 16 and basket 30 as shown in FIG. 13, may thus be moved with a line connected to the upper member 14. The stop 90 thus serves to prevent the suspended receptacle basket 30 from dropping relative to the flex joint 16 while being transported to the mounting bracket. Although not shown in the figures, all embodiments may be provided with a suitable stop for limiting axially downward movement of the receptacle basket while being transported with the joint 16.

It is a feature of the invention that the supported surface on the elongate member and the supporting surface on the basket are configured to allow rotation of the basket relative to the elongate member prior to suspending the basket from the mounting bracket. While the assembly including the elongate member and the receptacle basket are being moved in place for positioning on the mounting bracket, the receptacle basket may be conveniently turned so that the projecting formation may be easily aligned with the receiving formation, and the basket thereby reliably suspended from the mounting bracket.

In some applications, the selected bore in the receptacle basket may be lined with a desired coating or insert, as discussed above. Although a liner separate from the receptacle basket may be used, with the liner or insert having a selected angle bore therein, in many applications the liner or insert may be eliminated.

The receptacle basket of the present invention may be fabricated from conventional materials, and ideally complements the benefits of a tapered stress joint or flex joint in supporting a riser string or other elongate member with significantly increased versatility provided by the interconnection between the joint and the offshore structure. By making the receptacle basket removable with respect to the mounting bracket, the receptacle basket may be easily modified, depending on changes in the overall production operation. One elongate member may thus be removed with a receptacle basket and a new or modified elongate member installed with the basket on the mounting bracket. Stresses may be reduced by providing a mounting bracket which is movable relative to the structure, and which preferably allows for angular adjustment of the basket relative to the structure. Significant advantages are obtained by using a method which moves the assembly consisting of the tapered stress joint, the flex joint, or other supported surfaces on the elongate member and the basket with the supporting surface thereon into position on the mounting bracket. The basket may include a throughbore such that the basket supporting surface engages the supported surface on the elongate member to position the elongate member at a selected azimuth and declination with respect to the mounting bracket and thus the offshore structure.

While a preferred embodiments of the present invention has been illustrated in detail, it is apparent that modifications and adaptations of the disclosed embodiments will occur to those skilled in the art. However, it is to be expressly understood that such modifications and adaptations are within the spirit and scope of the present invention as set forth in the following claims.

What is claimed is:

1. A method of permanently supporting an elongate member from a surface or near surface offshore oilfield production structure, the elongate member extending downward from the structure toward one of a seabed or another structure and having a supported surface affixed to the elongate member, the method comprising:

fixing a mounting bracket to the structure;

positioning a dosed throat receptacle basket about the elongate member, the receptacle basket having a throughbore therein for receiving the elongate member and a basket supporting surface for planar engagement with the supported surface on the elongate member; and thereafter suspending an assembly including the receptacle basket and the elongate member from the mounting bracket for supporting the receptacle basket therefrom and thereby supporting the elongate member.

2. The method as defined in claim 1, further comprising:

forming a bore in the receptacle basket relative to an outer surface of the receptacle basket such that, when the supported surface of the elongate member is supported on the receptacle basket, the elongate member will be positioned at a selected azimuth and declination relative to the offshore structure.

3. The method as defined in claim 1, further comprising:

mounting the receptacle basket on the mounting bracket such that the receptacle basket is movable relative to the mounting bracket.

4. The method as defined in claim 1, further comprising:

adjusting an adjustment member to alter an angular position of the receptacle basket relative to the mounting bracket.

5. The method as defined in claim 1, further comprising:

providing a stop to limit axial downward movement of the receptacle basket relative to the elongate member.

6. The method as defined in claim 1, wherein the elongate member includes a flex joint or stress joint in engagement with the receptacle basket.

7. The method as defined in claim 1, wherein one of the mounting bracket and the receptacle bracket includes a projecting formation and the other of the mounting bracket and receptacle bracket includes a receiving formation.

8. A method of supporting an elongate member on a mounting bracket from a surface or near a surface offshore oilfield production structure, the elongate member extending downward from the structure toward one of a seabed or another structure and having a supported surface affixed to the elongate member, the method comprising:

positioning a closed throat receptacle basket about the elongate member, the receptacle basket having a throughbore therein for receiving the elongate member and a basket supporting surface for planar engagement with the supported surface on the elongate member; and thereafter suspending an assembly including the receptacle basket and the elongate member from the mounting bracket for supporting the receptacle basket therefrom and thereby supporting the elongate member.

9. The method as defined in claim 8, further comprising:

forming a bore in the receptacle basket relative to an outer surface of the receptacle basket such that, when the supported surface of the elongate member is supported on the receptacle basket, the elongate member will be positioned at a selected azimuth and declination relative to the offshore structure.

10. The method as defined in claim 8, further comprising:

mounting the receptacle basket on the mounting bracket such that the receptacle basket is movable relative to the mounting bracket.

11. The method as defined in claim 8, further comprising:

adjusting an adjustment member to alter an angular position of the receptacle basket relative to the mounting bracket.

12. The method as defined in claim 8, further comprising:

providing a stop to limit axial downward movement of the receptacle basket relative to the elongate member.

13. The method as defined in claim 8, wherein the elongate member includes a flex joint or stress joint in engagement with the receptacle basket.

14. The method as defined in claim 8, wherein one of the mounting bracket and the receptacle bracket includes a projecting formation and the other of the mounting bracket and receptacle bracket includes a receiving formation.

15. A method of supporting a flex joint or stress joint of an elongate member on a mounting bracket from a surface or near a surface offshore oilfield production structure the elongate member extending downward from the structure toward one of a seabed or another structure and having a supported surface affixed to the elongate member, the method comprising:

forming a bore in the receptacle basket relative to an outer surface of the receptacle basket such that, when the supported surface of the elongate member is supported on the receptacle basket, the elongate member will be positioned at a selected azimuth and declination relative to the offshore structure;

positioning a closed throat receptacle basket about the elongate member, the receptacle basket having a throughbore therein for receiving the elongate member and a basket supporting surface for planar engagement with the supported surface on the elongate member;

providing a stop to limit axial downward movement of the receptacle basket relative to the elongate member; and thereafter suspending an assembly including the receptacle basket and the elongate member from the mounting bracket for supporting the receptacle basket therefrom and thereby supporting the elongate member.

16. The method as defined in claim 15, further comprising:

mounting the receptacle basket on the mounting bracket such that the receptacle basket is movable relative to the mounting bracket.

17. The method as defined in claim 15, further comprising:

adjusting an adjustment member to alter an angular position of the receptacle basket relative to the mounting bracket.

18. The method as defined in claim 15, wherein one of the mounting bracket and the receptacle bracket includes a projecting formation and the other of the mounting bracket and receptacle bracket includes a receiving formation.

* * * * *